US011118753B1

(12) United States Patent
Zheng et al.

(10) Patent No.: US 11,118,753 B1
(45) Date of Patent: Sep. 14, 2021

(54) INTELLIGENT AURORA BOREALIS PROJECTION LAMP

(71) Applicant: Shenzhen Skoe Technology Co., Ltd., Shenzhen (CN)

(72) Inventors: Caijian Zheng, Shenzhen (CN); Wenzhen Ouyang, Shenzhen (CN)

( * ) Notice: Subject to any disclaimer, the term of this patent is extended or adjusted under 35 U.S.C. 154(b) by 0 days.

(21) Appl. No.: 17/358,005

(22) Filed: Jun. 25, 2021

(30) Foreign Application Priority Data

Apr. 30, 2021 (CN) ..... 202110485815.3

(51) Int. Cl.

| | |
|---|---|
| ***F21V 3/04*** | (2018.01) |
| ***F21V 14/08*** | (2006.01) |
| ***F21V 33/00*** | (2006.01) |
| *F21Y 115/10* | (2016.01) |
| *F21W 121/00* | (2006.01) |

(52) U.S. Cl.
CPC ..... *F21V 3/049* (2013.01); *F21V 14/08* (2013.01); *F21V 33/0056* (2013.01); *F21W 2121/008* (2013.01); *F21Y 2115/10* (2016.08)

(58) Field of Classification Search
CPC ..... F21V 3/049; F21V 14/08; F21V 33/0056; F21V 29/70; F21V 14/02; F21V 3/04; F21V 5/04; F21V 5/02; F21V 5/005; F21Y 2115/10; F21Y 2113/20; F21Y 2115/30; F21W 2121/008; F21S 10/063; F21S 10/00; F21S 10/007; F21S 10/002
See application file for complete search history.

(56) References Cited

U.S. PATENT DOCUMENTS

| | | | | |
|---|---|---|---|---|
| 4,779,176 | A * | 10/1988 | Bornhorst | G03B 15/02 353/62 |
| 10,830,410 | B1 * | 11/2020 | Wei | F21V 11/16 |
| 2006/0092638 | A1 | 5/2006 | Harwood | |
| 2020/0218140 | A1 | 7/2020 | So | |
| 2021/0164628 | A1 | 6/2021 | Zheng et al. | |

* cited by examiner

*Primary Examiner* — Bao Q Truong

(57) ABSTRACT

The present disclosure relates to an intelligent aurora borealis projection lamp, comprising a shell, a control panel arranged in the shell, an aurora borealis component, and a film component. The aurora borealis component includes a first LED light source component, a third optical lens, and a water ripple sheet; the film component includes a second LED light source component, a projection seat, a first optical lens arranged in the projection seat, and a dial component arranged above the first optical lens and used for fixing a film sheet; the dial component is moved to switch film sheet patterns above the projection seat; and the shell is provided with a lens cover corresponding to the upper part of the aurora borealis component.

8 Claims, 3 Drawing Sheets

INTELLIGENT AURORA BOREALIS PROJECTION LAMP

TECHNICAL FIELD

The present disclosure relates to a projection device, and in particular, an intelligent aurora borealis projection lamp.

BACKGROUND

Ambient lights are used in indoor places such as bedrooms, etc. Lamps are used to directly project light to create a starry sky and other environmental projection shapes, thereby creating corresponding atmospheres. An existing ambient projection lamp is basically a cloud-like or water ripple starry lamp correspondingly having a monotonous lighting effect, which easily causes visual fatigue.

SUMMARY

The technical problem to be solved in the present disclosure is to provide an intelligent aurora borealis projection lamp for the aforementioned defects in the prior art, so as to solve the defect of a monotonous projection light effect in the existing technical scope.

The technical solution used by the present disclosure to solve the technical problem is as follows: An intelligent aurora borealis projection lamp is provided, including a shell, a control panel arranged in the shell, an aurora borealis component, and a film component. The aurora borealis component includes a first LED light source component, a third optical lens arranged above the LED light source component and a water ripple sheet arranged above the third optical lens; the film component includes a second LED light source component, a projection seat, a first optical lens arranged in the projection seat, and a dial component arranged above the first optical lens and used for fixing a film sheet; the dial component is provided with projection holes corresponding to film sheet patterns; the bottom of the dial component is at least partially supported to the projection seat, and a side end of the dial component at least partially penetrates through the shell; the dial component is moved to switch the film sheet pattern above the projection seat; the shell is provided with a lens cover corresponding to the upper part of the aurora borealis component; the shell is provided with a second light outlet hole corresponding to a position above the film component; a second optical lens is arranged in the second light outlet hole; and the aurora borealis component and the film component are electrically connected to the control panel.

In one of the embodiments, the dial component includes a dial and a pressing sheet; the film sheet is arranged between the dial and the pressing sheet; the bottom of the dial is provided with a groove; the pressing sheet is arranged in the groove; and the dial and the pressing sheet are fixed through fixing pillars.

In one of the embodiments, the projection seat extends and is provided with a supporting part used for supporting the dial component.

In one of the embodiments, the shell includes an upper shell and a hemispheric lower shell; a laser component electrically connected to the control panel is also arranged in the shell, and includes a laser device and a grating sheet arranged at the upper part of the laser device; the upper shell is provided with a first light outlet hole at a position corresponding to an outlet of the laser device; the intelligent aurora borealis projection lamp further includes a bracket arranged below the shell; and the shell is rotatably connected to the bracket through a rotating shaft.

In one of the embodiments, the first LED light source component includes a first LED lamp panel, and at least one first LED light source that is uniformly distributed around the center of the first LED lamp panel serving as a circle center, the third optical lens corresponds to the first LED light source; the aurora borealis component further includes a lens bracket used for fixing the third optical lens; the intelligent aurora borealis projection lamp further includes a driving component; an output shaft of the driving component penetrates through the center of the first LED lamp panel; and the water ripple sheet is connected to the output shaft.

In one of the embodiments, the lens cover has a semicircular outline; the outer spherical surface of the lens cover is a grain-free smooth surface; and a plurality of irregular arc-shaped prisms are distributed on the inner spherical surface of the lens cover.

In one of the embodiments, the rotating shaft is arranged in a chamber of the lower shell; the bracket includes a semi-ring base and two connecting support arms; the lower shell is correspondingly provided with two strip-type grooves that are sunken inwards; the strip-type grooves are provided with first through holes for allowing the connecting support arms to be disposed in a penetrating manner; and the connecting support arms are arranged in the first through holes in a penetrating manner and are connected to the rotating shaft.

In one of the embodiments, the intelligent aurora borealis projection lamp further includes an audio component used for generating white noise; the audio component is electrically connected to the control panel; and a sound collection hole is formed in the shell.

In one of the embodiments, the audio component includes a horn arranged below the driving component and an audio control module arranged on the control panel; the horn is electrically connected to the control panel; and the lower shell is provided with sound outlet holes at a position corresponding to the lower part of the horn.

In one of the embodiments, the intelligent aurora borealis projection lamp further includes a Bluetooth module and a Wi-Fi module which are electrically connected to the control panel.

The present disclosure has the beneficial effects that by means of the arrangement of the aurora borealis component and the switchable film component, the light sources of aurora borealis are focused by the third optical lens and then projected through the water ripple sheet and the lens cover to present an aurora effect; the switchable film component improves the selectivity of patterns; and different patterns can be selectively projected through the dial component, without removing and replacing the film sheet at each time, so that the switchable film component is user-friendly.

BRIEF DESCRIPTION OF THE DRAWINGS

The present disclosure is further described below in combination with the accompanying drawings and embodiments. In the drawing.

1: shell; 11: upper shell; 12: lower shell; 13: power supply main board; 14: control panel; 15: decorative ring; 16: lens cover; 2: film component; 21: second LED light source component; 22: projection seat; 221: supporting part; 23: first optical lens; 24: dial component; 241: projection hole; 242: dial; 243: pressing disk; 244: locating shaft; 245: fixing pillar; 25: second light outlet hole; 26: second optical lens; 27: film sheet; 3: aurora borealis component; 31: first LED light source component; 32: water ripple sheet; 33: third optical lens; 34: lens bracket; 41: grating sheet; 42: laser device; 43: first light outlet hole; 44: heat dissipater, 51: motor; 52: motor cover; 6: bracket; 71: strip-type groove; 72: rotating shaft; 8: limiting component; 91: horn; 92: sound outlet hole; 93: button component; 94: USB interface.

DESCRIPTION OF THE EMBODIMENTS

Now with reference to the drawings, the preferred embodiments of the present disclosure are described in detail.

Figure 1:
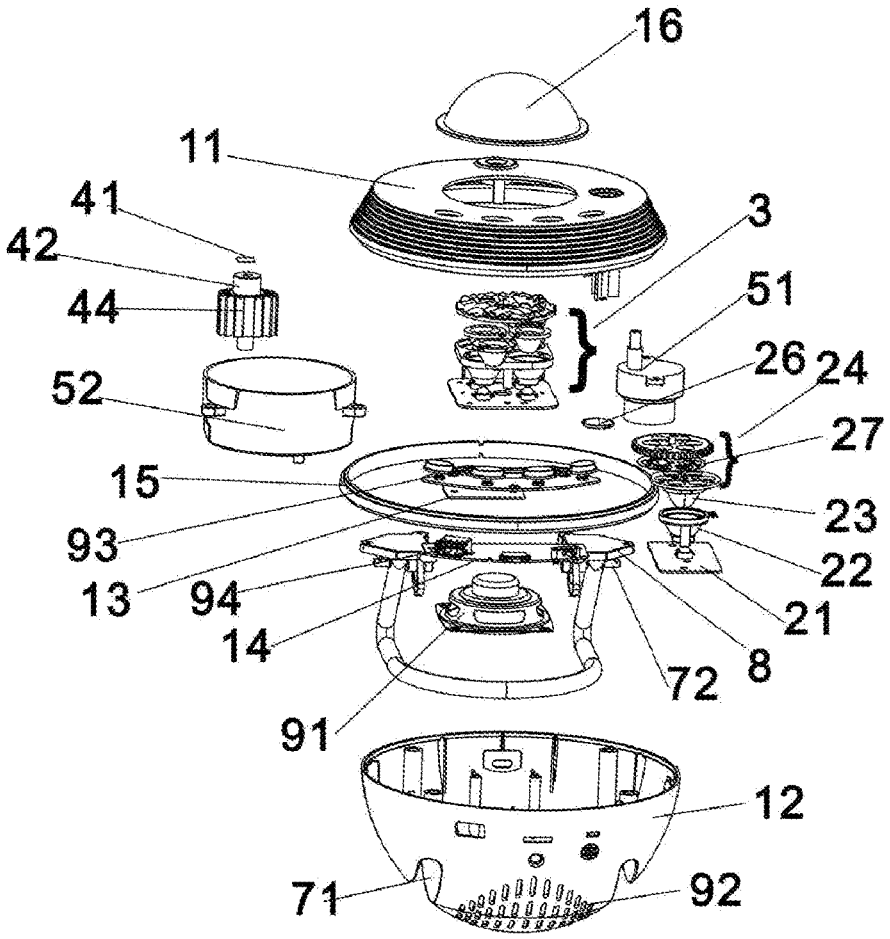
FIG. 1 is an exploded structural diagram of an intelligent aurora borealis projection lamp of the present disclosure.
Figure 2:
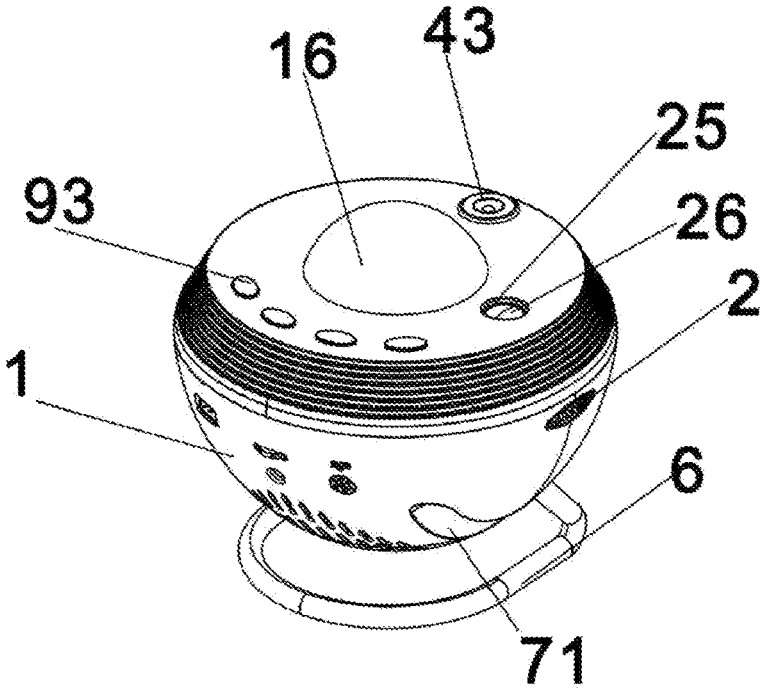
FIG. 2 is an overall schematic structural diagram of an intelligent aurora borealis projection lamp of the present disclosure.
Figure 3:
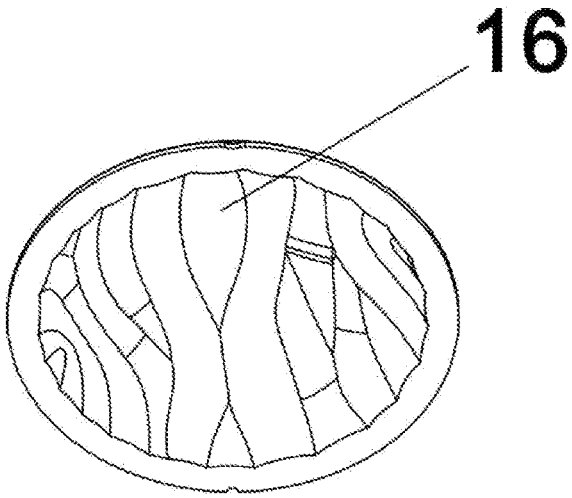
FIG. 3 is a schematic structural diagram of the inner side of a lens cover of the present disclosure.
Figure 4:
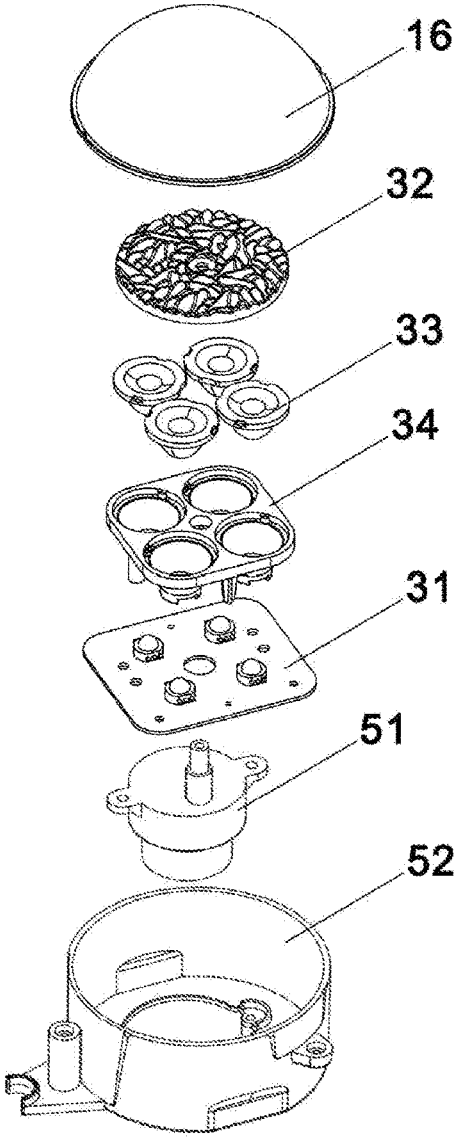
FIG. 4 is a schematic structural diagram of an aurora borealis component of the present disclosure.
Figure 5:
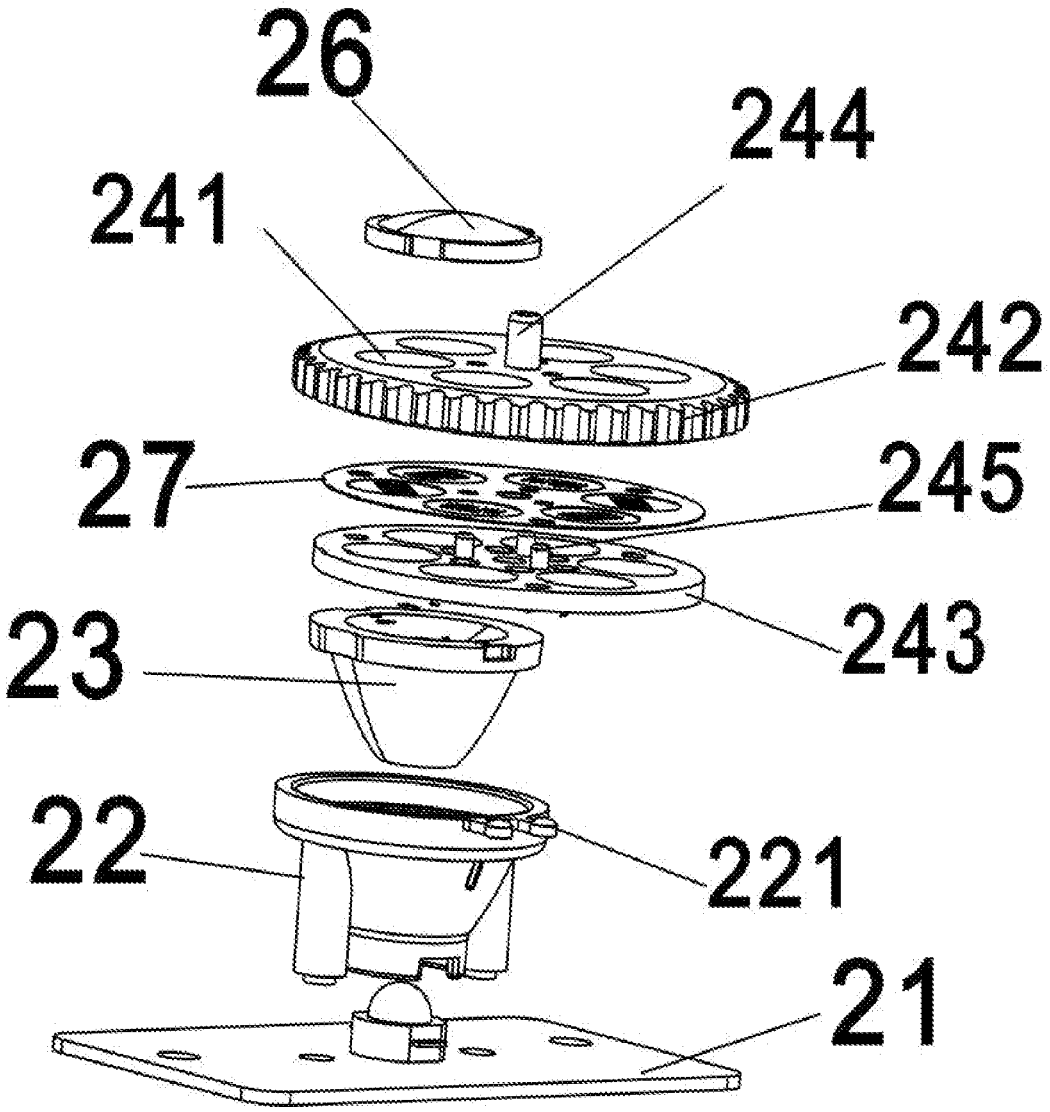
FIG. 5 is a schematic structural diagram of a film component of the present disclosure.

As shown in FIG. 1 to FIG. 5, an intelligent aurora borealis projection lamp is provided, including a shell 1, a control panel 14 arranged in the shell 1, an aurora borealis component 3, and a film component 2. The aurora borealis component 3 and the film component 2 are electrically connected to the controller 14. The aurora borealis component 3 is used for presenting an aurora borealis effect and includes a first LED light source component 31, a third optical lens 33 arranged above the LED light source component, and a water ripple sheet 32 arranged above the third optical lens 33; the shell 1 is provided with a lens cover 16 corresponding to the upper part of the aurora borealis component 3; a light source of the first LED light source component 31 is focused by the third optical lens 33 and then projected through the water ripple sheet 32 and the lens cover 16 to present an aurora effect.

The film component 2 includes a second LED light source component 21, a projection seat 22, a first optical lens 23 arranged in the projection seat 22, and a dial component 24 arranged above the first optical lens 23 and used for fixing a film sheet 27; the dial component 24 is provided with projection holes 241 corresponding to film sheet patterns; the bottom of the dial component 24 is at least partially supported to the projection seat 22, and a side end of the dial component 24 at least partially penetrates through the shell 1; the shell 1 is provided with a second light outlet hole 25 corresponding to a position above the film component 2; and a second optical lens 26 is arranged in the second light outlet hole 25. The dial component 24 is moved to switch the film sheet patterns above the projection seat 22 to present different film sheet patterns, such as a moon, a celestial body, a constellation, and stars; the number of patterns of the projection lamp is increased; and the use feeling of a user is enhanced.

Specifically, the shell 1 includes an upper shell and a lower shell; the first LED light source component 31 includes a first LED lamp panel and at least one first LED light source uniformly distributed around the center of the first LED lamp panel serving as a circle center, the third optical lens 33 corresponds to the first LED light source; the aurora borealis component 3 further includes a lens bracket 34 used for fixing the third optical lens 33; light of the first LED light source is focused by the third optical lens 33 to the water ripple sheet 32 and then is projected by the lens cover 16. In the present embodiment, there are four first LED light sources, so that four third optical lenses 33 are correspondingly provided and fixed above the first LED lamp panel through the lens bracket 34. In other embodiments, there can be one or more first LED light sources.

The intelligent aurora borealis projection lamp further includes a driving component that includes a motor 51 and an output shaft; the output shaft penetrates through the first LED lamp panel and the center of the lens bracket 34 and presses against the water ripple sheet 32; the water ripple sheet 32 is driven by the driving component to move; the water ripple sheet 32 moves under the driving of the motor 51, so that imaged aurora borealis moves in an opposite direction, which is more irregular than a traditional water ripple effect to bring a better visual effect to the user. Much further, the driving component further includes a motor cover 52 arranged in the shell 1; the driving component and the aurora borealis component 3 are arranged in the motor cover 52; and the lens cover 16 is pressed on the motor cover 52, so that the aurora borealis component 3 is facilitated to be aligned with the lens cover 16, and the whole internal structure is neater.

The lens cover 16 has a semicircular outline; the outer spherical surface of the lens cover 16 is a grain-free smooth surface; and a plurality of irregular arc-shaped prisms are distributed on the inner spherical surface of the lens cover 16. After the water ripple pattern of the aurora borealis component 3 is reflected and refracted by the lens cover 16, the projection effect greatly simulates an aurora borealis effect, and a projection area is larger.

The intelligent aurora borealis projection lamp further includes a laser component that is arranged in the shell 1 and is electrically connected to the control panel 14; the laser component includes a laser device 42 and a grating sheet 41 arranged at the upper part of the laser device 42; a heat dissipater 44 is arranged on the laser device; and the upper shell is provided with a first light outlet hole 43 at a position corresponding to an outlet of the laser device 42.

For the film component 2, the dial component 24 includes a dial 242 and a pressing sheet 243; the film sheet 27 is arranged between the dial 242 and the pressing sheet 243; and the dial component 24 is provided with the projection holes 241 at positions corresponding to the film sheet patterns. Specifically, the bottom of the dial 242 is provided with a groove; the pressing sheet 243 is arranged in the groove; the center of the dial 242 is provided with a locating shaft 244; and the dial component 24 is moved to rotate around the locating shaft 244 serving as a center. The dial 242 and the pressing sheet 243 are connected through fixing pillars 245 to realize synchronous rotation. Specifically, corresponding fixing holes can be uniformly distributed on the dial 242 and the pressing sheet 243, and the fixing pillars 245 corresponding to the fixing holes are arranged at the corresponding positions. For example, three fixing pillars 245 can be uniformly arranged at the center position of the pressing sheet 243, and three fixing pillars 245 can be arranged on the outer side of the lower end of the dial 242, so as to ensure connection between the pressing sheet 243 and the dial 242.

Much further, the second LED light source component 21 includes a second LED lamp panel and a second LED light source arranged on the second LED lamp panel; the first optical lens 23 is arranged in the projection seat 22; the bottom of the projection seat 22 is provided with a through hole; and the second LED light source penetrates through the through hole and is focused by the first optical lens 23.

The upper part of the projection seat 22 extends and is provided with a supporting part 221 used for supporting the dial component 24; and the arrangement of the supporting part 221 ensures that the gravity center of the dial component 24 is on the projection seat 22 to prevent instability of the dial component 24 when the dial 242 is moved.

In the present embodiment, there are six film sheet patterns that are uniformly disposed, and there are also six corresponding projection holes 241 of the dial component 24 that are uniformly distributed. In other embodiments, two projection holes 241 or projection holes in other numbers of the dial component 24 corresponding to the film sheet patterns can be provided.

The second light outlet hole 25 is used for light exiting of the film component 2; the second optical lens 26 is arranged in the second light outlet hole 25; and the second optical lens 26 is used for focusing of the film sheet 27 to ensure that the film sheet patterns are displayed clearly and integrally. The second LED light source is located on the same straight line as the film sheet patterns, the projection holes 241 and the second optical lens 26.

In the present embodiment, in order to further broaden the use scenario of the intelligent aurora borealis projection lamp, the intelligent aurora borealis projection lamp further includes a bracket 6 arranged below the shell 1; and the shell 1 is rotatably connected to the bracket 6 through a rotating shaft 72. The projection effect is enhanced by the bracket 6 with adjustable angle to bring a visual feast to the user and make it easier for the user to get relax.

The shell 1 can be made of a plastic material; a decorative ring 15 can be arranged between the upper shell 11 and the lower shell 12 to improve the ornamental value of the appearance of the shell 1; and the lower shell 12 is hemispheric. In the present embodiment, the rotating shaft 72 is arranged in a chamber of the lower shell 12; the bracket 6 includes a semi-ring base and two connecting support arms; the lower shell 12 is correspondingly provided with two strip-type grooves 71 that are sunken inwards; the strip-type grooves 71 are provided with first through holes for allowing the corresponding connecting support arms of the bracket 6 to be disposed in a penetrating manner; and the connecting support arms are arranged in the through holes in a penetrating manner and are connected to the rotating shaft 72 in the chamber of the lower shell 12. The lower shell 12 is set to be hemispheric, so that the rotatable connection between the rotating shaft 72 and the connecting support arms are used to enable the shell 1 to rotate along an opening direction of the strip-type grooves 71.

Much further, in order to enable the shell 1 of the intelligent aurora borealis projection lamp to be fixed in a certain direction, a limiting component 8 that cooperates with the rotating shaft 72 is also arranged in the lower shell 12 to fix the intelligent aurora borealis projection lamp.

The intelligent aurora borealis projection lamp further includes an audio component used for generating white noise; the audio component is electrically connected to the control panel 14; and a sound collection hole is formed in the shell 1. Further, the intelligent aurora borealis projection lamp further includes a Bluetooth module and a Wi-Fi module; and the Bluetooth module and the Wi-Fi module are arranged on the control panel 14. The Bluetooth module and the Wi-Fi module can realize wireless communication between the control panel 14 and a terminal such as a mobile phone or an intelligent sound box; a function of playing music is realized by mobile phone control; an on or off state of light and switching of light effects can be controlled through a mobile phone application (APP) or the intelligent sound box; the working state of the intelligent aurora borealis projection lamp can be remotely controlled at a fixed time point; and a function of remotely and wirelessly adjusting the brightness of light is realized.

The audio component can play burn white noise, and can also be connected to intelligent equipment through the Bluetooth module or the Wi-Fi module to play an audio file or music. In the present embodiment, the audio component includes a horn 91 arranged below the driving component and an audio control module arranged on the control panel 14; the horn 91 is arranged below the driving component; the audio control module is arranged on the control panel 14; the horn 91 is electrically connected to the control panel 14; the lower shell 12 is provided with sound outlet holes 92 at a position corresponding to the lower part of the horn 91; and the music playing function can be realized by controlling the audio control module.

A power supply main board 13 used for supplying power to the intelligent aurora borealis projection lamp is also arranged in the shell 1; and the power supply main board 13 is electrically connected to the control panel 14. The shell 1 is also provided with a USB interface 94 that is connected to the control panel 14 and used for supplying power to the intelligent aurora borealis projection lamp. The intelligent aurora borealis projection lamp further includes button components 93 arranged on the shell 1; and the button components 93 include buttons and a button main board; and the button main board is electrically connected to the control panel 14. The button components 93 can include buttons 931 used for volume adjustment, light on/off, music mode switching, light brightness and other functions. The intelligent aurora borealis projection lamp can be directly controlled through the button components 93.

The intelligent aurora borealis projection lamp of the present disclosure is selectable to more scenarios through the switchable film component to enhance the experience of the user.

It should be noted that the terms "perpendicular", "horizontal", "coaxial", "left" and similar expressions used herein are for illustrative purposes only, and are not meant to be the only implementation modes.

All the technical features of the embodiments described above can be arbitrarily combined. In order to simplify the description, all possible combinations of the technical features in the above embodiments have not been described. However, the combinations of these technical features should be considered as the scope described in this description as long as there is no contradiction in them.

It should be understood that the above embodiments are only used to illustrate the technical solutions of the present disclosure, not to limit the technical solutions. Those skilled in the art can make modifications to the technical solutions in the embodiments described above, or make equivalent replacements to partial technical features; and these modifications and replacements shall all fall within the protection scope of claims appended of the present disclosure.

What is claimed is:

1. An intelligent aurora borealis projection lamp, comprising a shell, a control panel arranged in the shell, an aurora borealis component, and a film component, wherein the aurora borealis component comprises a first LED light source component, a third optical lens arranged above the LED light source component, and a water ripple sheet arranged above the third optical lens; the film component comprises a second LED light source component, a projection seat, a first optical lens arranged in the projection seat, and a dial component arranged above the first optical lens and used for fixing a film sheet; the dial component is provided with projection holes corresponding to film sheet patterns; the bottom of the dial component is at least partially supported to the projection seat, and a side end of the dial component at least partially penetrates through the shell; the dial component is moved to switch the film sheet patterns above the projection seat; the shell is provided with a lens cover corresponding to the upper part of the aurora borealis component; the shell is provided with a second light outlet hole corresponding to a position above the film component; a second optical lens is arranged in the second light outlet hole; the aurora borealis component and the film component are electrically connected to the control panel;

the dial component comprises a dial and a pressing sheet; the film sheet is arranged between the dial and the pressing sheet; the bottom of the dial is provided with a groove; the pressing sheet is arranged in the groove; the dial and the pressing sheet are fixed through fixing pillars;

the projection seat extends and is provided with a supporting part used for supporting the dial component.

2. The intelligent aurora borealis projection lamp according to claim 1, wherein the shell comprises an upper shell and a hemispheric lower shell; a laser component electrically connected to the control panel is also arranged in the shell, and comprises a laser device and a grating sheet arranged at the upper part of the laser device; the upper shell is provided with a first light outlet hole at a position corresponding to an outlet of the laser device; the intelligent aurora borealis projection lamp further comprises a bracket arranged below the shell; and the shell is rotatably connected to the bracket through a rotating shaft.

3. The intelligent aurora borealis projection lamp according to claim 2, wherein the first LED light source component comprises a first LED lamp panel, and at least one first LED light source that is uniformly distributed around the center of the first LED lamp panel serving as a circle center, the third optical lens corresponds to the first LED light source; the aurora borealis component further comprises a lens bracket used for fixing the third optical lens; the intelligent aurora borealis projection lamp further comprises a driving component; an output shaft of the driving component penetrates through the center of the first LED lamp panel; and the water ripple sheet is connected to the output shaft.

4. The intelligent aurora borealis projection lamp according to claim 3, wherein the lens cover has a semicircular outline; the outer spherical surface of the lens cover is a grain-free smooth surface; and a plurality of irregular arc-shaped prisms are distributed on the inner spherical surface of the lens cover.

5. The intelligent aurora borealis projection lamp according to claim 2, wherein the rotating shaft is arranged in a chamber of the lower shell; the bracket comprises a semi-ring base and two connecting support arms; the lower shell is correspondingly provided with two strip-type grooves that are sunken inwards; the strip-type grooves are provided with first through holes for allowing the connecting support arms to be disposed in a penetrating manner, and the connecting support arms are arranged in the first through holes in a penetrating manner and are connected to the rotating shaft.

6. The intelligent aurora borealis projection lamp according to claim 2, wherein the intelligent aurora borealis projection lamp further comprises an audio component used for generating white noise; the audio component is electrically connected to the control panel; and a sound collection hole is formed in the shell.

7. The intelligent aurora borealis projection lamp according to claim 6, wherein the audio component comprises a horn arranged below the driving component and an audio control module arranged on the control panel; the horn is electrically connected to the control panel; and the lower shell is provided with sound outlet holes at a position corresponding to the lower part of the horn.

8. The intelligent aurora borealis projection lamp according to claim 7, wherein the intelligent aurora borealis projection lamp further comprises a Bluetooth module and a Wi-Fi module which are electrically connected to the control panel.

* * * * *